United States Patent [19]

Schultz et al.

[11] 4,169,390

[45] Oct. 2, 1979

[54] ADJUSTING MECHANISM FOR A SNAP-ACTING BELLEVILLE WASHER

[75] Inventors: Phillip E. Schultz, Milwaukee; Robert G. Crepeau, Greendale, both of Wis.

[73] Assignee: Allen-Bradley Company, Milwaukee, Wis.

[21] Appl. No.: 890,613

[22] Filed: Mar. 20, 1978

[51] Int. Cl.[2] ..... H01H 35/24

[52] U.S. Cl. ..... 74/2; 200/83 P; 200/83 S

[58] Field of Search ..... 200/83 P, 83 S, 329, 200/330; 74/2, 100 P; 337/319, 323; 251/321-323

[56] References Cited

U.S. PATENT DOCUMENTS

| | | | |
|---|---|---|---|
| 2,824,919 | 2/1958 | Davis | 200/83 P |
| 3,036,173 | 5/1962 | Perkins | 200/83 P |
| 3,133,171 | 5/1964 | Griffith | 200/83 S |
| 3,302,269 | 2/1967 | Cooper | 29/155.5 |
| 3,584,168 | 6/1971 | Halpert | 200/83 P |
| 3,588,395 | 6/1971 | Hersey | 200/83 S |
| 3,816,685 | 6/1974 | Fiore | 200/83 S |

*Primary Examiner*—Gerald P. Tolin
*Attorney, Agent, or Firm*—Thad F. Kryshak

[57] ABSTRACT

A pressure control assembly having a snap-acting Belleville washer responsive to fluid pressure, and a switch actuating mechanism movable therewith, includes an adjusting mechanism for the snap-acting Belleville washer. The adjusting mechanism includes at least one pin which can be moved along the surface of the Belleville washer to change the Belleville washer's pivot point by increasing or decreasing its lever arm, thus varying its snap pressure. In the preferred embodiment, there are three pins which extend through aligned slots in an upper and lower plate and the pins can be moved radially inwardly and outwardly by rotating the lower plate relative to the upper plate.

11 Claims, 8 Drawing Figures

4
3
2
5a
58
49
48
50
34
53
57
52
51
56
5
54
55
56a
1
61
46
43
44
42
47
7
45
39
10
40
41
33
38
35
36
37
59
60
9
26
21
21a
5b
8
20
22
23
15
19
18
20a
6
17
14
13
12
16
11

ADJUSTING MECHANISM FOR A SNAP-ACTING BELLEVILLE WASHER

BACKGROUND OF THE INVENTION

This invention relates to an adjusting mechanism for a pressure control assembly, and more particularly to an adjustable device which may vary the lever arm of a Belleville washer in a pressure control assembly.

The operation of a pressure control should provide for the accurate and positive actuation and de-actuation of an electrical switch at desired pressure differentials. To accomplish this, Belleville washers have been used in pressure controls because of their positive and effective snap action. However, the use of Belleville washers has not been totally satisfactory because of inherent manufacturing tolerances that result in varying spring rates for individual Belleville washers. A series of Belleville washers may be manufactured from the same batch of raw materials, using the same process, and heat set in the same manner, and yet each may not snap at precisely the same pressure as the next due to these inherent manufacturing tolerances. Slight variations in the thickness or height of each Belleville washer, may produce vastly varying snap pressures. The problem of compensating for the manufacturing tolerances in the spring rate of a Belleville washer in a pressure control is commonly encountered when designing a control for a particular application. Therefore, it would be desirable to have a mechanism that would correct for such tolerances, and improve the overall accuracy of a pressure control.

These types of manufacturing tolerances are also found in other springs, such as coil springs, used in combination with a Belleville washer in pressure control assemblies. Thus, an additional problem encountered is that the spring rates for the Belleville washer and the other springs in the assembly must be properly balanced so as to accurately determine the point of snapover for the Belleville washer.

Prior art attempts to correct for such tolerances and accurately calibrate a snap-acting diaphragm are described in U.S. Pat. No. 3,584,168 issued June 8, 1971, to Halpert for a "Fluid Pressure Operated Diaphragm Switch With Improved Means and Method for Calibration," and U.S. Pat. No. 3,816,685 issued June 11, 1974, to Fiore for a "Pressure Responsive Device Having Improved Means for Calibration." These methods use a calibration plate located beneath the diaphragm to preset the actuation and de-actuation pressure for the snap-acting diaphragm by deforming the plate to a desired position. Another approach described in U.S. Pat. No. 3,302,269 issued Feb. 7, 1967, to Cooper for "Methods of Making Condition Responsive Devices," introduces controlled hydraulic fluid pressure to pre-form a diaphragm blank to the desired configuration. However, these attempts have not been entirely satisfactory.

SUMMARY OF THE INVENTION

The present invention relates to a pressure control with an improved adjusting mechanism for varying the snap-pressure of a Belleville washer. More specifically, the invention relates to a pressure control with an adjusting mechanism for varying the snap pressure of the Belleville washer by changing its pivot point to increase or decrease the lever arm and as a result the snap pressure.

The adjusting mechanism of the present invention comprises at least one movable pin which contacts the surface of the Belleville washer. When the pin contacts the surface of the Belleville washer close to its center axis the lever arm is increased causing the pressure required to snap the washer to be decreased and when the point of contact is moved closer to the periphery of the washer the lever arm is decreased and there is a corresponding increase in the amount of pressure required to snap the washer.

In a preferred embodiment, the adjusting mechanism comprises a first plate having a set of three arcuately shaped oblique slots formed therethrough, a second plate having a set of three radial slots extending therethrough disposed coaxially under the first plate and a set of three movable pins which project through both the opposing oblique and radial slots. The thus described adjusting mechanism is disposed between the switch actuating mechanism and the Belleville washer with the pin heads in contact with the surface of the Belleville washer. The points of contact of the pin heads on the surface of the Belleville washer provide pivot points which determine the lever arm of the washer and its snap pressure. The second plate of the adjusting mechanism is rotatable relative to the first plate to move the pins radially along the washer surface to vary the pivot point, lever arm and snap pressure.

It is an object of the invention to provide a simple, reliable adjusting mechanism to compensate for manufacturing tolerances in the production of snap-acting Belleville washers.

It is another object of the invention to provide an improved mechanism for balancing the spring rate of a Belleville washer with that of other springs in a pressure control assembly.

It is another object of the invention to provide a mechanism that is easily adjustable to vary the snap pressure of a Belleville washer without removing the mechanism from within the pressure control assembly.

The foregoing and other objects and advantages of the invention will appear from the following description. In the description, reference is made to the accompanying drawings which form a part hereof, and in which there is shown by way of illustration and not of limitation a preferred embodiment of the invention. Such embodiment does not represent the full scope of the invention, but rather the invention may be employed in many different embodiments, and reference is made to the claims herein for interpreting the breadth of the invention.

DESCRIPTION OF THE PREFERRED EMBODIMENT

Figure 1:
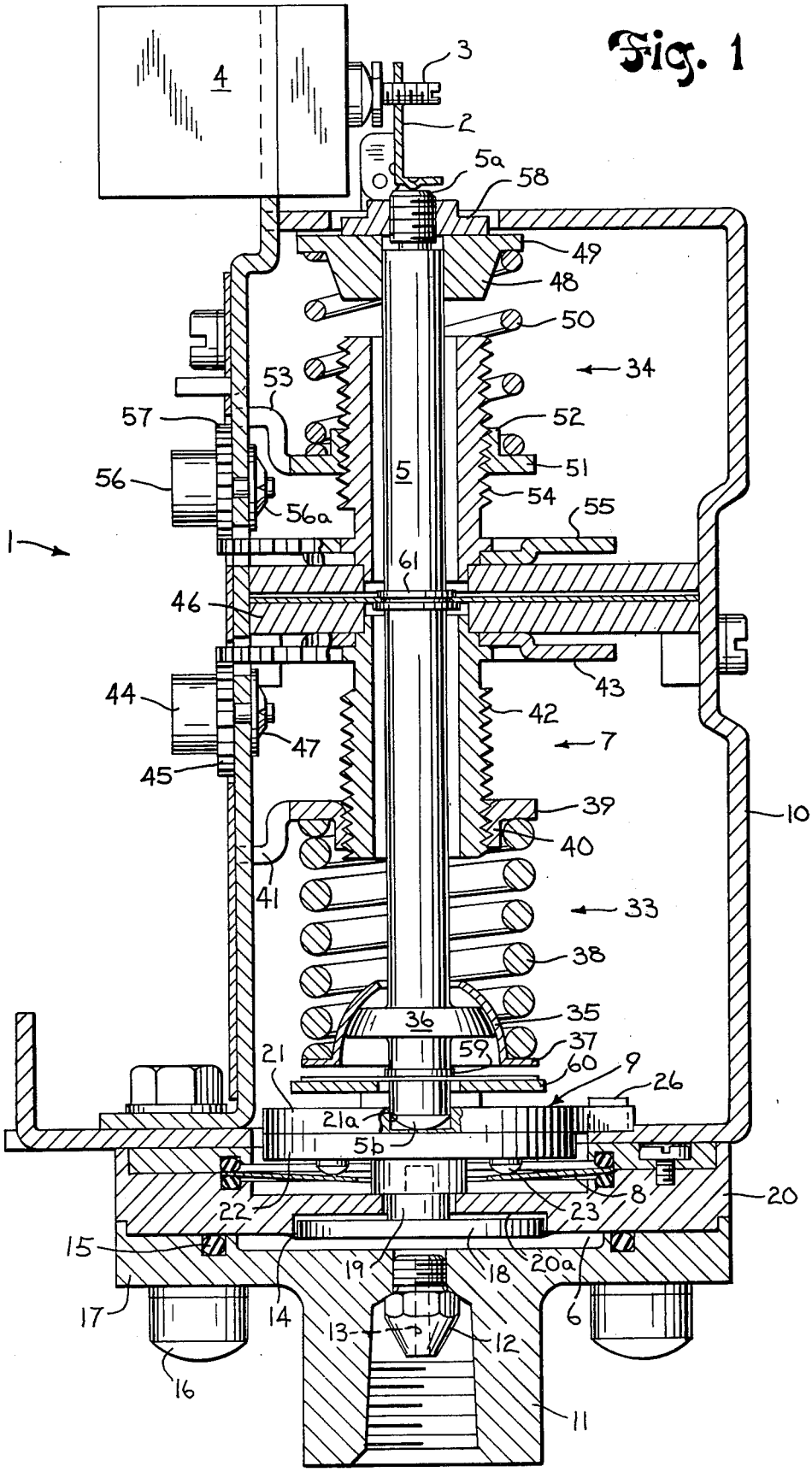
FIG. 1 is a side view in elevation, in vertical section, of a pressure control which incorporates the adjusting mechanism of the present invention.
Figure 2:
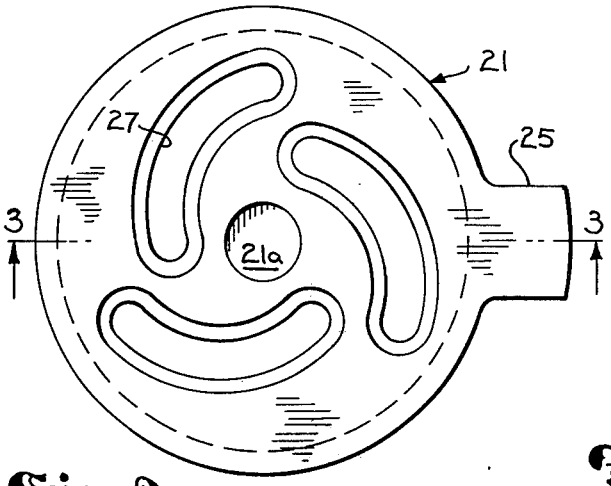
FIG. 2 is a plan view of the upper plate of the preferred adjusting mechanism.

Referring to FIG. 1 it can be seen that a pressure control generally designated 1 is operatively connected by a pivoted connecting link 2 to an on-off lever 3 of an electrical switch 4. The link 2 is connected to one end 5*a* of a switch actuating or operating shaft 5 which moves in response to pressure exerted on its other end 5*b*. To insure a positive and effective movement of the shaft when a desired fluid pressure is sensed in a pressure chamber 6, a switch actuating mechanism 7 which includes a snap-acting Belleville washer 8 and an adjusting mechanism 9 for varying the snap pressure of the washer is interposed between the pressure chamber 6 and the connecting link 2 which controls the on-off lever 3 of the electrical switch 4.

Referring to the pressure control 1 it can be seen that the switch actuating mechanism 7 is mounted within a frame 10. The pressure chamber 6 is located beneath the frame 10. Pressure reaches the pressure chamber 6 from a source of pressure by passing through a threaded inlet adaptor 11 closed by a pulsation plug 12 having a central orifice 13. The sole means of passage into and out of the pressure chamber 6 is the orifice 13. The pressure chamber 6 is isolated from the remainder of the switch actuating mechanism 7 by a flexible diaphragm 14, and is sealed from atmospheric pressure by an O-ring 15 which also cooperates with fasteners 16 and the adapter plate 17 in holding the diaphragm 14 securely in place.

As seen in the drawing, a plunger 18 having an upwardly extending central projection 19 is positioned in a housing 20. The housing 20 includes a plunger receiving recess 20*a*. The plunger 18 rests upon the upper surface of the diaphragm 14. When pressure is exerted upon the bottom surface of the diaphragm 14 and the plunger 18 is moved upwardly and the force of the pressure is transmitted via the projection 19 to the switch actuating mechanism 7. The recess 20*a* is slightly larger in diameter than the plunger 18 which allows the incoming pressure to be applied against the entire head of the plunger 18 by the diaphragm 14. The depth of the recess 20*a* limits the extent to which the plunger 18 can be moved.

As can be seen in FIG. 1, the adjusting mechanism 9 is positioned between the other end 5*b* of the operating shaft 5 and the Belleville washer 8 and contacts the projection 19 of the plunger 18. If desired the projection 19 of the plunger 18 could be shaped and sized to be received in the bore and serve as an additional guide for the plunger 18.

The adjusting mechanism 9 which is comprised of an upper plate 21 and a lower plate 22 and pins 23 will now be described in detail.

Figure 3:
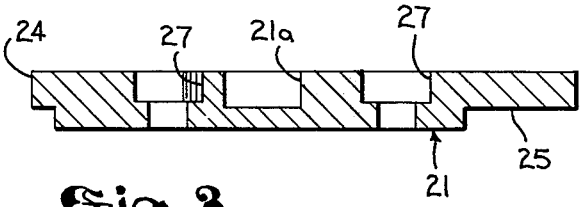
FIG. 3 is a side view in cross-section of the upper plate taken along the plane 3—3 of FIG. 2.

As seen in FIGS. 2, 3, 6 and 7 the upper plate 21 is generally circular in shape and has a radial extending top flange 24 with a projecting tab 25. When the adjusting mechanism is positioned in the pressure control as seen in FIG. 1 the upper plate 21 is anchored against rotation by the tab 25 which is then seated between a pair of projections 26 only one of which is shown. The upper plate 21 has a set of three arcuately shaped oblique slots 27 formed therethrough that start near the axis of the upper plate 21 and terminate near its circumference, or periphery. Corresponding points along the arcuate axis of each of the slots 27 are 120° apart from one another and are located on a circle concentric with the axis of the upper plate 21. Although straight slots can be used, slots that are arcuate in shape are preferred since that configuration reduces friction when an adjustment of the Belleville washer 8 is desired as will hereinafter be described. The slots 27 are "oblique" in that a tangent line drawn from any point along the arcuate axis presents an oblique angle with a radius drawn through the same point. As seen in FIG. 3, each slot 27 extends completely through the upper plate 21, and is T-shaped with the shank portion of the T extending through the main body of the upper plate 21. The upper plate 21 is also provided a central cylindrical recess 21*a* which is adapted to receive the other end 5*b* of the operating shaft 5 (as seen in FIG. 1).

Figure 4:
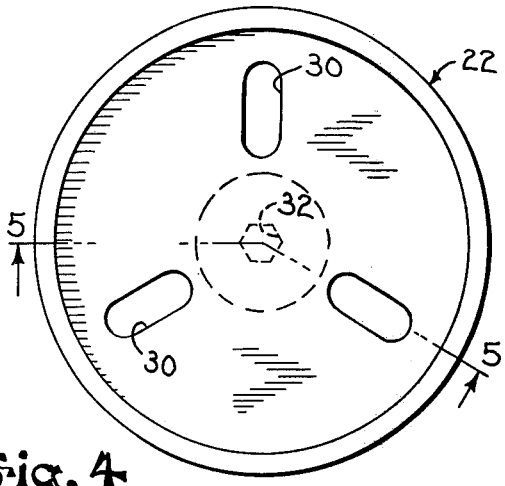
FIG. 4 is a plan view of the lower plate of the preferred adjusting mechanism.
Figure 5:
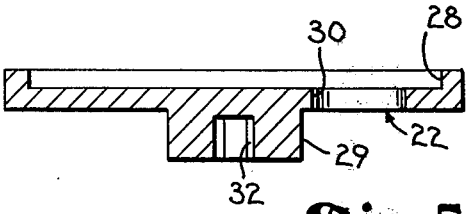
FIG. 5 is a side view in cross-section of the lower plate taken along the plane 5—5 of FIG. 4.

FIGS. 4 and 5 show the circular shaped lower plate 22 which has a recess 28 which accommodates the main portion of the upper plate 21. The lower plate 22 also has a cylindrical depending spacer 29 which extends axially downwardly to engage the projection 19 of the plunger 18 as seen in FIG. 1.

As best seen in FIG. 4, lower plate 22 has a set of three radial slots 30 formed therethrough. These radial slots 30 are the same width as the shank portion of the oblique slots 27 and extend from points near the axis of the lower plate 22 to points near its circumference. The radial slots 30 start and terminate at points that correspond to those of the oblique slots 27 in the upper plate 21. As with the oblique slots 27, the radial slots 30 are also 120° apart from one another and corresponding points along their radial axes are all located on a circle concentric with the axis of the lower plate 22.

Figure 6:
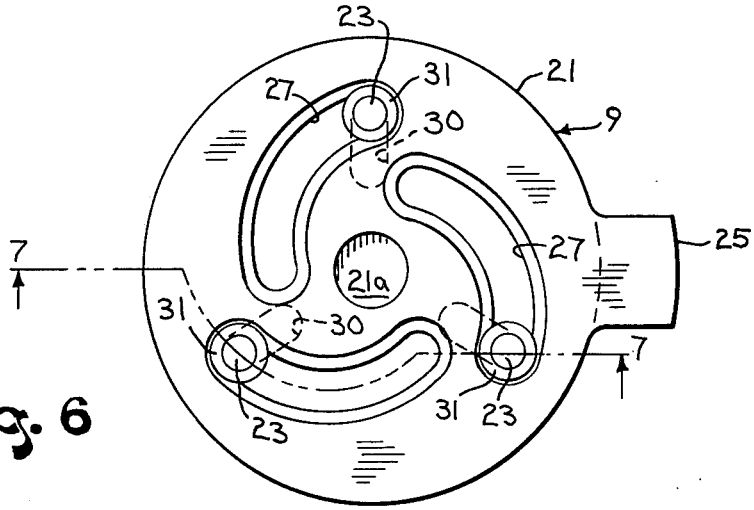
FIG. 6 is a plan view of the assembled adjusting mechanism.
Figure 7:
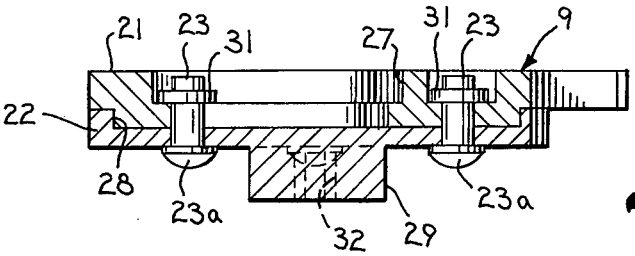
FIG. 7 is a side view in cross-section of the adjusting mechanism taken along line 7—7 of FIG. 6.

Referring now to FIGS. 6 and 7, there is shown the assembled adjusting mechanism 9 with the upper plate 21 in the recess 28 of the lower plate 22, and the three pins 23 extending through opposing aligned portions of the oblique and radial slots 27 and 30. The heads 23*a* of the pins 23 are preferably spherical in shape to provide a single point of contact and elastic annular retainers 31 encircle the shank portions of the pins to hold the pins 23 in place and the upper plate 21 and lower plate 22 together.

In order to adjust the snap pressure of the Belleville washer 8 the heads 23*a* of the pins are moved radially along the surface of the Belleville washer 8 to present different pivot points thereon. This is accomplished by rotating the lower plate 22 relative to the upper plate 21.

Returning now to FIGS. 4 and 5, it can be seen that in the preferred embodiment a hexagonal bore 32 extends axially through the spacer 29. The bore 32 is adapted to receive a tool, such as an allen wrench, so that the lower plate can be rotated. If it is desired to change the snap pressure of the Belleville washer of a completely assembled control assembly 1 as shown in FIG. 1, it is necessary to first remove the adapter plate 17, the diaphragm 14 and the plunger 18 and then insert a hexagonally shaped tool, such as an allen wrench, into the hexagonal bore 32 to turn the lower plate 22. As the lower plate 22 rotates the pins 23 to move in a radial direction. The upper plate 21 is prevented from rotating by the tab 25 anchored between the projections 26. This adjustment changes the location of the pin heads 23*a*, the pivot points on the washer surface and the effective lever arm. As the lever arm increases or decreases the fluid pressure required for snap action of the Belleville washer is decreased or increased, respectively.

The adjusting mechanism of the present invention does not alter the mechanical procedures which are performed by the switch actuating mechanism 7 in actuating and de-actuating the electrical snap switch 4.

The switch actuating mechanism 7 of the pressure control shown in the drawing includes a trip pressure setting mechanism 33 and a pressure differential adjusting mechanism 34. The trip pressure setting mechanism 33 is located in the lower portion of the housing 10 and the pressure differential adjusting mechanism 34 in the upper portion.

Returning now to FIG. 1, it can be seen that the shaft 5 is provided adjacent the lower end 5*b* with a spring cup 35 which is attached to an integral flange 36 on the shaft 5. The spring cup 35 has a circumferential lip 37 upon which is seated a range spring 38 which circumvents the shaft 5. The opposite end of the range spring 38 bears against a range adjusting plate 39 having a dependent axial flange 40 which prevents the range spring 38 from sliding off the plate 39. The range adjusting plate 39 has legs 41 which extend into slots in the frame 10 to prevent the adjusting plate 39 from rotating. The legs 41 also cooperate with a trip pressure scale on the outside of the frame 10 to indicate the trip pressure for the pressure control assembly 1. The axial flange 40 is threadedly connected to the shank 42 of the range gear 43 which may be rotated by turning a knob 44 and pinion 45. The range gear 43 is bottomed on the underside of frame support plate 46 so that it cannot move axially. A push nut 47 secures the knob 44 and pinion 45 to the front of the frame 10 and allows them to turn freely without tightening or loosening. Since the range gear 43 cannot move axially, its rotation by turning pinion 44 forces the adjusting plate 39 to move axially to compress or de-compress the range spring 38 to set the desired trip pressure for the pressure control.

The pressure differential adjusting mechanism of the switch actuating mechanism 7 shown in the drawing includes a differential spring plate 48 that slides freely along its axis on the upper end of the operating shaft 5. The spring plate 48 has a circumferential lip 49 upon which is seated a differential spring 50. At its opposite end, the differential spring 50 bears against a differential adjusting plate 51 having an upwardly extending axial flange 52 that prevents the differential spring 50 from sliding sideways. The differential adjusting plate 51 also has legs 53 which extend into slots in the front plate of the frame 10. The legs 53 prevent the differential adjusting plate 51 from rotating, and are also used in cooperation with a differential pressure scale on the front of the frame to indicate the differential pressure for the pressure control 1. The axial flange 52 of the differential adjusting plate 51 is threadedly connected to the shank 54 of a differential gear 55 that may be rotated to compress the differential spring 50 by turning a differential knob 56 and pinion 57 held securely by a push nut 56*a* in the same manner as for compressing the range spring 38. Since the differential gear 55 does not move axially and the differential adjusting plate 51 is prevented from rotating, the rotating of the differential gear 55 forces the differential adjusting plate 51 to move axially to compress or de-compress the differential spring 50.

A differential adjusting nut 58 is used in cooperation with the compression of the differential spring 50 to obtain the desired pressure differential or re-set pressure. The differential adjusting nut 58 is threadedly connected to the top of the operating shaft 5, and when turned down forces the slidable spring plate 48 away from the frame 10. The significance of this adjusting will hereinafter be explained.

Figure 8:
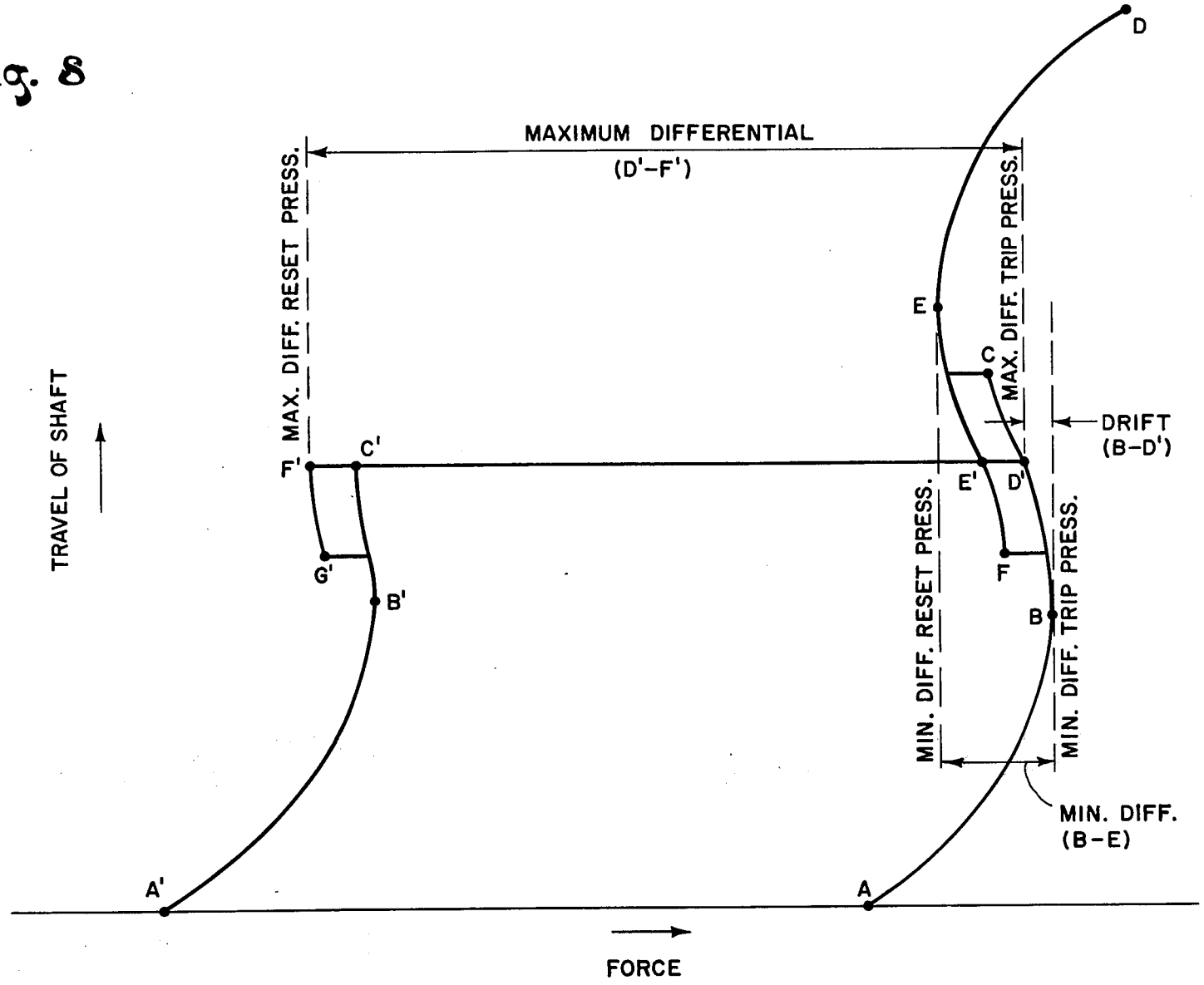
FIG. 8 is a typical pressure control force curve for the assembly of FIG. 1.

During operation of the pressure control 1 at minimum pressure differential, that is, when the differential spring 50 is not compressed, pressure enters the pressure chamber 6 through the orifice 13 in the pulsation plug 12 and is applied against the head of the plunger 18 by the diaphragm 14. The applied pressure increases until its force plus the initial upward force of the Belleville washer 8 are enough to overcome the opposing initial forces of the range spring 38, components of the electrical snap switch 4 and the friction forces of the shaft guide 59 in the centering plate 60. At this point, the plunger 18 will move upwardly with any further increase in pressure, point A, FIG. 8. When the pressure does increase, the snap over of the Belleville washer 8 will occur when the overall spring rate of the system changes from positive to negative, point B, FIG. 8. Snap over causes the plunger 18 to continue to move upward against the adjusting mechanism 9 which forces the operating shaft 5 to trip the electrical snap switch 4 through connecting link 2 and on-off lever 3, point C, FIG. 8. At this point, FIG. 8 shows a linear decrease in force. This decrease is caused by the snapping of internal components in the switch 4. The upward movement of the operating shaft 5 is limited by the plunger 18 grounding in the recess 20*a*, point D, FIG. 8.

Upon decreasing pressure, the same mechanical procedure discussed above occurs, only in reverse. First, the upward force on plunger 18 decreases upon decreasing pressure until the opposing downward forces of the range spring 38 and components in electrical snap switch 4 are great enough to overcome the upward forces of the applied pressure, the Belleville washer 14 and friction in the system. As the pressure decreases the plunger 18 begins moving downwardly, point D, FIG. 8, until the spring rate of the overall system changes from positive to negative causing snap over, point E, FIG. 8. Snap over allows the range spring 38 to force the spring cup 35 downwardly which causes the operating shaft 5 to move downwardly so that connecting link 2 may pivot away from electrical snap switch 4, allowing it to re-set, point F, FIG. 8. Downward movement of the operating shaft 5 is limited by the spacer 29 grounding on the housing 20, point A, FIG. 8.

At no time during the above operation at minimum differential is the differential spring 50 under compression. However, if it is desired to increase the differential between the trip pressure and re-set pressure, compression of the differential spring 50 may accomplish this by lowering the re-set pressure while keeping the trip pressure approximately the same. Compression of the differential spring 50 is accomplished by turning the differential knob 56. Once the differential spring 50 is under compression, it creates an upward force on the operating shaft 5, equal to A′–A, FIG. 8, and therefore, less pressure is necessary to initiate movement of plunger 18, point A′, FIG. 8. As pressure increases, snap over of the Belleville washer 8 occurs in the same manner as previously described herein for operation at minimum differential, point B′, FIG. 8. However, when operating at other than minimum differential, the movement of the operating shaft 5 is designed such that when the differential spring plate 48 meets the underside of the frame 10 upon snap over and stops the upward movement of the operating shaft 5, point C′, FIG. 8, the electrical snap switch 4 has not yet been tripped. The purpose of the differential adjusting nut 58 is to provide for such a result. The adjusting nut 58 is turned down on the operating shaft 5 until it has moved the spring plate 48 the proper distance away from the underside of the top of the frame 10. Thus, when the spring plate 48 hits the frame 10 at snap over, the connecting link 2 and on-off lever 3 have not moved far enough to trip the switch 4. Furthermore, when the spring plate 48 hits the frame 10, the Belleville washer 8 has not completely traveled through its snap cycle because of the resistance of the range spring 38, as seen in FIG. 8. At this point the upward force of differential spring 50 is no longer an integral force in the system, and therefore, the applied pressure must increase to enable operating shaft 5 to continue moving upward to trip electrical snap switch 4. Pressure will increase against the plunger 18 until it forces the operating shaft 5 to begin upward movement, point D', FIG. 8. Once movement has begun, the Belleville washer completes its snap cycle, and no further pressure increase is required. Thus, the differential adjusting nut 58 lifts off the differential spring plate 48, and the operating shaft 5 trips the electrical snap switch 4, point C, FIG. 8. Upward movement of the operating shaft 5 is stopped by the plunger 18 hitting the top wall of the recess 20*a*, point D, FIG. 8. The pressure at which movement of the operating shaft 5 is re-established is considered the trip pressure, point D', FIG. 8, because snap action by the Belleville washer 8 immediately follows to trip the electrical snap switch 4. The trip pressure, point D', FIG. 8, may be slightly less than what it was at minimum differential depending upon the overall slope of the system force curve. This is called "drift" and is equal to B–D' in FIG. 8.

Under decreasing pressure, the same sequence of mechanical events as with minimum differential operation allow the operating shaft 5 to move downwardly until the differential adjusting nut 58 engages the differential spring plate 48, point E', FIG. 8. As previously noted, that is designed to occur before the electrical snap switch 4 resets. At this point, no further downward movement of the operating shaft 5 will occur until the pressure is decreased enough to compensate for the addition of the upward force of the differential spring 50, point F', FIG. 8. Once the pressure has sufficiently decreased, snap over by the Belleville washer 8 occurs, and operating shaft 5 is forced downwardly by the range spring 38 allowing electrical snap switch 4 to re-set, point G', FIG. 8. The pressure at which movement of the operating shaft 5 is re-established is considered to be the re-set pressure because the snap action of the Belleville washer 8 follows immediately thereafter. Downward travel is stopped by the spacer 29 of the adjusting mechanism 9 bottoming on the housing 20, point A', FIG. 8.

Referring again to FIG. 1, it can be seen that the operating shaft 5 is guided in its movement by the recess 21*a* of the upper plate 21 of the adjusting means 9, the guide ring 59 in the centering plate 60, and guide ring 61 in the support plate 46.

It will be readily apparent to those skilled in the art that the foregoing descriptions of the pressure control have been for purposes of illustration only and that the unique adjusting mechanism for the Belleville washer can be utilized in pressure controls having different types of switch actuating mechanisms including those which do not have re-set or differential pressure capabilities.

The adjusting mechanism which has been described provides a highly accurate and easily adjustable means for changing the snap pressure of a Belleville washer in a pressure control assembly. However, it will be apparent that various modifications might be made without departing from the spirit of the invention. For example, although the use of three pins is preferable, any number of pins symmetrically positioned might be used and the pins need not have any specific structural features as long as each presents substantially a single point of engagement with the Belleville washer. It is for this reason that a spherical head is preferred. Additionally, the oblique slots formed in the upper plate are preferably arcuate because this shape aids adjustment by reducing friction, but they might also be straight or otherwise shaped provided they perform their required function. In addition, the adjusting mechanism could consist of a single plate with adjustable or non-adjustable pins, if desired. In view of these and other modifications, the invention is not intended to be limited by the drawings or description herein, except insofar as may be specifically required.

We claim:

1. In a pressure control assembly having a snap-acting Belleville washer responsive to fluid pressure, and a switch actuating mechanism movable therewith, adjusting means for adjusting the snap pressure of the Belleville washer comprising:

a first plate member, said first plate member having at least one oblique slot formed therethrough;

a second plate member disposed coaxially with said first plate member and rotatable with respect to said first plate member, said second plate member having at least one radial slot formed therethrough; and a pin member projecting through opposing oblique and radial slots to engage the surface of said snap-acting Belleville washer and provide a pivot point thereon, said pin member being radially adjustable along the surfaces of said snap-acting Belleville washer by rotating said second plate member.

2. A pressure control assembly as described in claim 1, wherein:

said pin member has a spherically shaped head engaging the surface of said snap-acting Belleville washer at substantially a single point.

3. A pressure control assembly as described in claim 1, wherein:

said first plate member has a set of three oblique slots;

said second plate member has a set of three radial slots and pin members projecting through each pair of opposing oblique and radial slots to engage the surface of said snap-acting Belleville washer.

4. A pressure control assembly of claim 1, wherein:

said first plate member has anchoring means to prevent said first plate member from being rotated with the second plate member.

5. A pressure control assembly of claim 1, wherein:

said oblique slot is arcuate in shape.

6. In a pressure control assembly having a snap-acting Belleville washer responsive to fluid pressure, and a switch actuating mechanism movable therewith, means for adjusting the snap pressure of the Belleville washer comprising:

a first plate member disposed between said switch actuating mechanism and said snap-acting Belleville washer and movable therewith, said first plate member having a set of three arcuately shaped oblique slots therethrough;

a second plate member disposed coaxially with said first plate member and rotatable with respect to said first plate member, said second plate member having a set of three radial slots formed therethrough; and a set of three pin members, each pin projecting through a pair of opposing oblique and radial slots to engage the surface of said snap-acting Belleville washer, said pin members being radially adjustable along the surface of said snap-acting Belleville washer by rotating said second plate member with respect to said first plate member.

7. The pressure control assembly of claim 6, wherein:

said first plate member has a radially projecting tab anchored to the pressure control assembly to prevent said first plate member from rotating when the pin members are being adjusted.

8. An adjusting mechanism for changing the pivot point of a snap-acting Belleville washer comprising:

a first plate member having at least one oblique slot formed therethrough;

a second plate member disposed coaxially with said first plate member and rotatable with respect to said first plate member, said second plate member having at least one radial slot formed therethrough; and a movable pin member projecting through opposing oblique and radial slots, said pin member being radially movable by rotating said second plate member with respect to said first plate member.

9. An adjusting mechanism as described in claim 8, wherein:

said oblique slots are arcuate in shape.

10. In a pressure control including a snap-acting Belleville washer which is responsive to pressure, and a switch actuating mechanism movable therewith, the improvement which comprises an adjusting means for varying the snap pressure of the Belleville washer which adjusting means includes:

a plate-like support member having a slot formed therein;

a pin member movably retained in the slot which contacts the surface of the Belleville washer, said pin member being movable along the surface of the washer to provide variable pivot points thereon to change the lever arm of the washer and to effect its snap pressure; and means for moving the pin member to different contacts points on the surface of the Belleville washer.

11. In a pressure control including a snap-acting Belleville washer which is responsive to pressure, and a switch actuating mechanism movable therewith, the improvement which comprises an adjusting means for varying the snap pressure of the Belleville washer which adjusting means includes:

a support member positioned adjacent the Belleville washer;

a movable pin member which contacts the surface of the Belleville washer at substantially a single point, said pin member being mounted to said support member; and means for moving the pin member to substantially any point on a radius of the Belleville washer to provide variable pivot points for the washer so as to change its lever arm and effect its snap pressure.

* * * * *